US006595252B1

(12) United States Patent
Bassett et al.

(10) Patent No.: US 6,595,252 B1
(45) Date of Patent: Jul. 22, 2003

(54) METHOD OF ASSEMBLING A FLOOR-BRIDGING UNIT

(76) Inventors: Wayne L. Bassett, 634 N. Fourth St., Sunbury, PA (US) 17801; Darwin R. Bassett, 1246 Highland Ave., Sunbury, PA (US) 17801

( * ) Notice: Subject to any disclaimer, the term of this patent is extended or adjusted under 35 U.S.C. 154(b) by 149 days.

(21) Appl. No.: 09/896,645

(22) Filed: Jun. 29, 2001

Related U.S. Application Data

(60) Provisional application No. 60/215,624, filed on Jun. 30, 2000.

(51) Int. Cl.[7] ..... B27F 1/00; B27L 5/00

(52) U.S. Cl. ..... 144/347; 29/428; 29/897.31; 144/2.1; 144/133.1; 144/136.1; 144/346; 144/353; 144/246.1; 144/253.5; 144/203; 144/3.1; 144/354; 144/355

(58) Field of Search ..... 29/428, 897.31, 29/897.312; 144/1.1, 3.1, 133.1, 136.1, 346, 353, 203, 347, 354, 355, 246.1, 253.1, 253.5, 2.1, 371; 248/164, 431; 52/692, 693, 729.4, 730.1; 83/875, 435.12, 435.15

(56) References Cited

U.S. PATENT DOCUMENTS 3,665,982 A * 5/1972 Kvalheim
3,732,906 A * 5/1973 Welgas ..... 144/133.1 X
5,592,800 A * 1/1997 Koo et al. ..... 52/692

* cited by examiner

*Primary Examiner*—W. Donald Bray
(74) *Attorney, Agent, or Firm*—John J. Elnitski, Jr.

(57) ABSTRACT

A method of producing the floor-bridging units, which increases production rate of the floor-bridging units. First rough lumber beams are fed through a planer, which planes the lumber to the required consistent size tolerance. The planed lumber is transferred to a cut-off saw to cut the legs. The legs are transferred to a dado machine and a dado slot is cut into the lumber. The legs are transferred to a joining station to form the X member, where the dado slots are joined into a dado joint by gluing and stapling the joint. The X member is transferred to a trimming station to be trimmed. At the same time flanges are being made by cutting sheet lumber in strips and then into rectangles to form the flanges. The flanges are transferred to a nailing jig, while glue is applied to the trimmed ends of the legs of the X members. The X members with the applied glue are transferred to the nailing jig. Finally, the flanges are nailed to the glued ends of the X members and the finished floor-bridging units are transferred to a packaging area.

16 Claims, 5 Drawing Sheets

METHOD OF ASSEMBLING A FLOOR-BRIDGING UNIT

This application claims the benefit of U.S. Provisional Application No. 60/215,624, filed Jun. 30, 2000 and hereby incorporates it by reference.

BACKGROUND

Floor-bridging units 10 are used for framing floors of wood buildings. FIG. 1 shows an example of a floor-bridging unit 10. The floor-bridging unit 10 is generally an X shaped member 12 with flanges 14 attached to two sides 16. The floor-bridging units 10 are placed between floor joists 18 and nailed through the flange 14 to the joist 18, as seen in FIG. 2. Once installed in rows between the joists 18, they transmit point loads from one joist 18 to the adjacent joists 18 by supplying support to the joists 18 in compression or tension. The floor-bridging units 10 add stiffness and rigidity to the floor system. The increase in rigidity and stiffness allows for longer joist spans, shallower joists 18, or wider on-center joists 18, thereby providing for more cost-effective material usage.

The floor-bridging unit 10 is usually constructed by creating the X member 12 from two legs 22 of #2 grade kiln dried spruce 2×3s. The 2×3 are each planed to tolerance, mitered on the ends and dado cut at the center to remove a portion of material from each piece, as shown in FIG. 3. The two dado cut slots 24 are then joined together with glue and staples to form the X member 12 of the floor-bridging unit 10. The ¾" Douglas Fir plywood flanges 14 are then glued and nailed to the ends of the X member 12 to form the floor-bridging unit 10, as shown in FIG. 1. Current industry practices are to first plane the 2×3 lumber for the legs 22 and then to cut the lumber to length using a hand operated miter saw. The 2×3 lumber is actually about 1 and ½ inches by 2 and ½ inches and is planed downed to a consistent 1 and ½ inches by 2 and 7/16 inches. The lumber is planed because initially the lumber is not a consistent size and needs to be in order to maintain the manufacture of a quality product. Once cut to length, the dado slot 24 is cut into the legs 22 by a saw. Two legs 22 are joined at the dado slots 24 to create a dado joint and form the X member 12. This joint is glued and stapled together. The ends of the joined legs 22 are trimmed to tolerance in a table saw. To make the flanges 14, sheet wood is cut into strips and then into rectangles on a table saw. Glue is then applied by hand to the four ends of the dado joined legs 22 of X member 12. After the glue is applied, the rectangles are positioned onto the ends by hand and nailed in place using a hand operated nail gun.

It is an object of the present invention is to provide a method of mass producing floor-bridging units 10 in an efficient and cost effective manner.

SUMMARY OF THE INVENTION

A method of producing the floor-bridging units, which increases production rate of the floor-bridging units. First rough lumber beams are fed through a planer, which planes the lumber to the required consistent size tolerance. The planed lumber is transferred to a cut-off saw to cut the legs. The legs are transferred to a dado machine and a dado slot is cut into the lumber. The legs are transferred to a joining station to form the X member, where the dado slots are joined into a dado joint by gluing and stapling the joint. The X member is transferred to a trimming station to be trimmed. At the same time flanges are being made by cutting sheet lumber in strips and then into rectangles to form the flanges. The flanges are transferred to a nailing jig, while glue is applied to the trimmed ends of the legs of the X members. The X members with the applied glue are transferred to the nailing jig. Finally, the flanges are nailed to the glued ends of the X members and the finished floor-bridging units are transferred to a packaging area.

DETAILED DESCRIPTION

Figure 1:
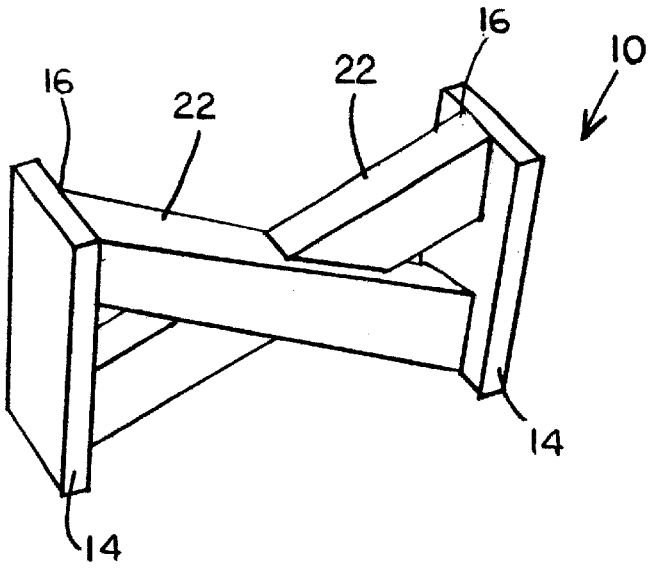
FIG. 1 is a perspective view of a floor-bridging unit.

The present invention is a method of producing the floor-bridging units 10, which increases production rate of the floor-bridging units 10. First rough lumber beams are fed through a planer, which planes the lumber to the required consistent size tolerance. The planed lumber is transferred to a cut-off saw to cut the legs 22. The legs 22 are transferred to a dado cutting station and a dado slot 24 is cut into the lumber of the leg 22. The legs 22 are transferred to a joining station to form the X member 12, where the dado slots 24 are joined into a dado joint by gluing and stapling the joint. The X member 12 is transferred to a trimming station to be trimmed. At the same time flanges 14 are being made by cutting sheet lumber in strips and then into rectangles to form the flanges 14. The flanges 14 are transferred to a nailing jig at a nailing station, while glue is applied to the trimmed ends of the legs 22 of the X members 12. The X members 12 with the applied glue are transferred to the nailing jig. Finally, the flanges 14 are nailed to the glued ends of the X members 12 and the finished floor-bridging units 10 are transferred to a packaging area. The following is a detailed description of the method of the present invention.

Figure 4:
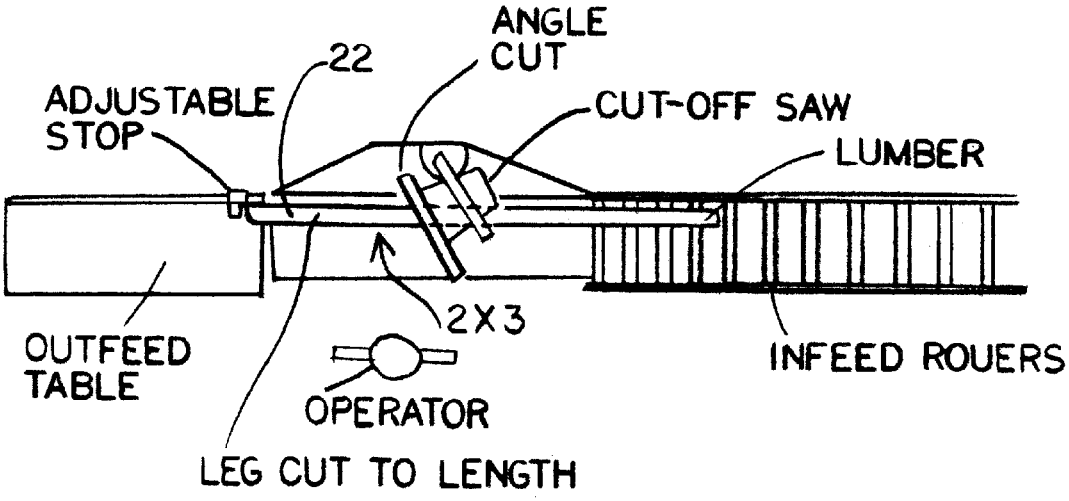
FIG. 4 is a top schematic view of cutting the legs according to the present invention.

There are two parallel lines that join up for the final assembly of the floor-bridging units 10. A first line is the 2×3 processing line. A second line is the flange processing line. The nailing jig is at the end of the first and second lines, where the final assembly of the floor-bridging units 10 takes place. At the beginning of the first line, rough shaped 2×3 lengths of lumber are currently planed on two sides to provide a consistent size. The planed 2×3 lengths of lumber are then transferred to a cut-off saw on in-feed rollers. At the cut-off saw the leading end of each length of lumber is angle cut as shown in FIG. 4. An adjustable stop is positioned further down from the cut-off saw to produce legs 22 of the same length. The angle cut end is butted against the stop and the lumber is angle cut to produce a leg 22. The leg 22 is removed and the remaining lumber is moved against the stop to cut another leg 22. The angle cut is approximately close to the actual angle needed on each end of the leg 22, which saves on lumber waste. When the legs 22 are remove from the cut-off saw, the legs 22 are placed on a conveyer to move the legs 22 to a dado cutting station. After cutting of the legs 22 to length and before dado cutting of the legs 22, the first end of the legs 22 which rested against the stop is marked with a felt tip marker to index the legs 22.

Figure 5:
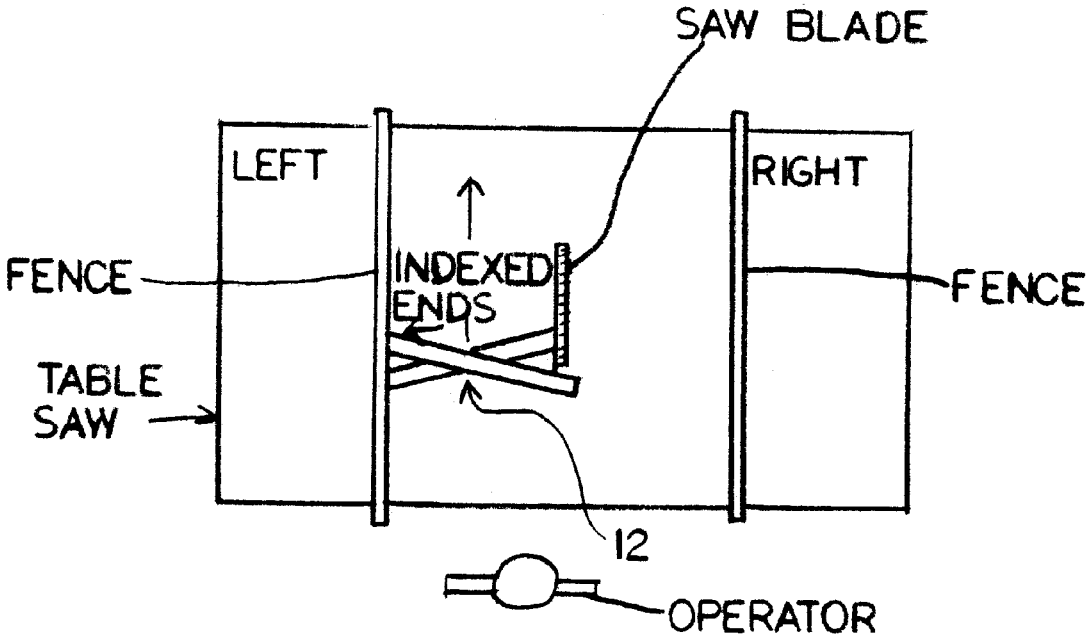
FIG. 5 is a top schematic view of trimming an X member according to the present invention.
Figure 6:
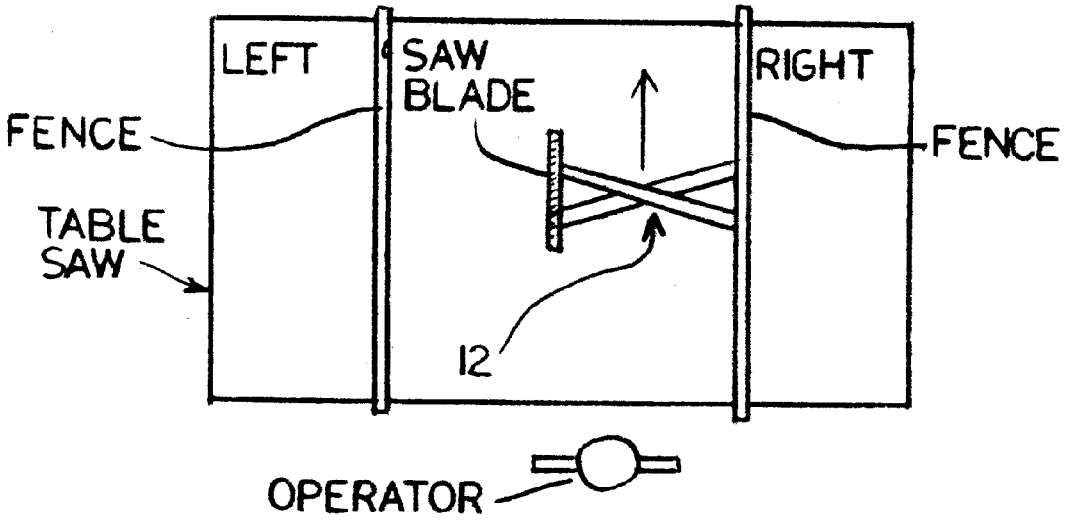
FIG. 6 is another top schematic view of trimming the X member according to the present invention.

Each leg 22 is positioned in the dado machine, such that each indexed end of each leg 22 is located in the same position on the dado machine, and the dado slot 24 is cut. The indexed ends of the legs 22 are matched during the assembly of two legs 22 into the X member 12, such that the indexed ends are on the same side of the X member 12 that is formed. The two legs 22 are glued together at the dado slot 24. After the glue has been applied and the pieces properly fit, the joint is stapled. The X members 12 are then moved to a table saw to be trimmed. The table saw includes a left fence and a right fence, as shown in FIGS. 5–6. First the index ends are placed against the left fence and the right side of the X member 12 is trimmed, such that the distance between the center of the X member 12 and the trimmed right side is the required center to side length. The X member 12 is then moved such that the newly trimmed right side is positioned against the right fence, so that the left side can be trimmed. Finally, the left side of the X member 12 is trimmed, such that the distance between the center of the X member 12 and the trimmed left side is the required center to side length. The finished X member 12 is then place on a conveyer and moved to the nailing jig.

Figure 3:
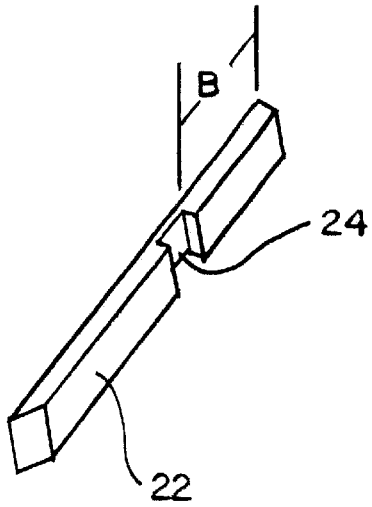
FIG. 3 is a perspective view of installed floor-bridging units.
Figure 2:
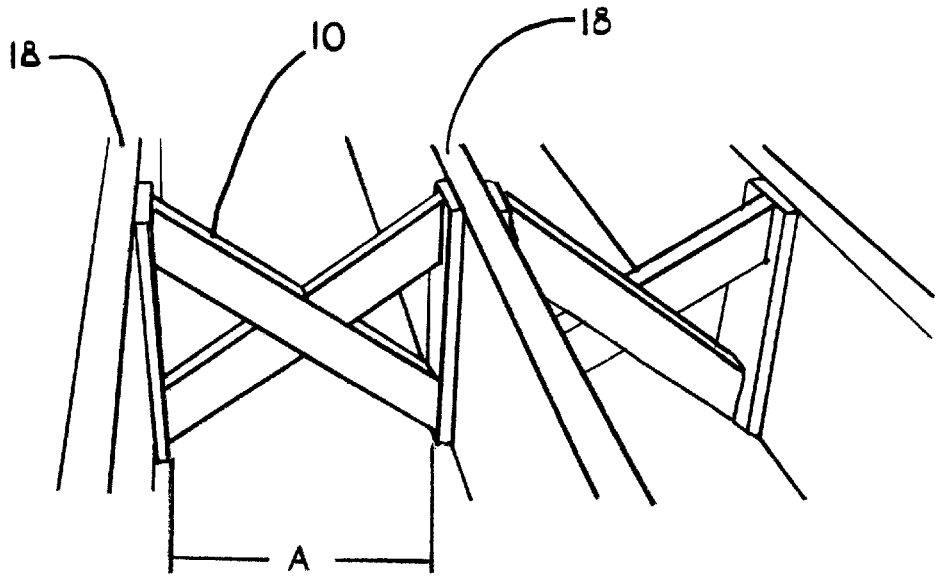
FIG. 2 is a perspective view of a leg of the floor-bridging unit.
Figure 7:
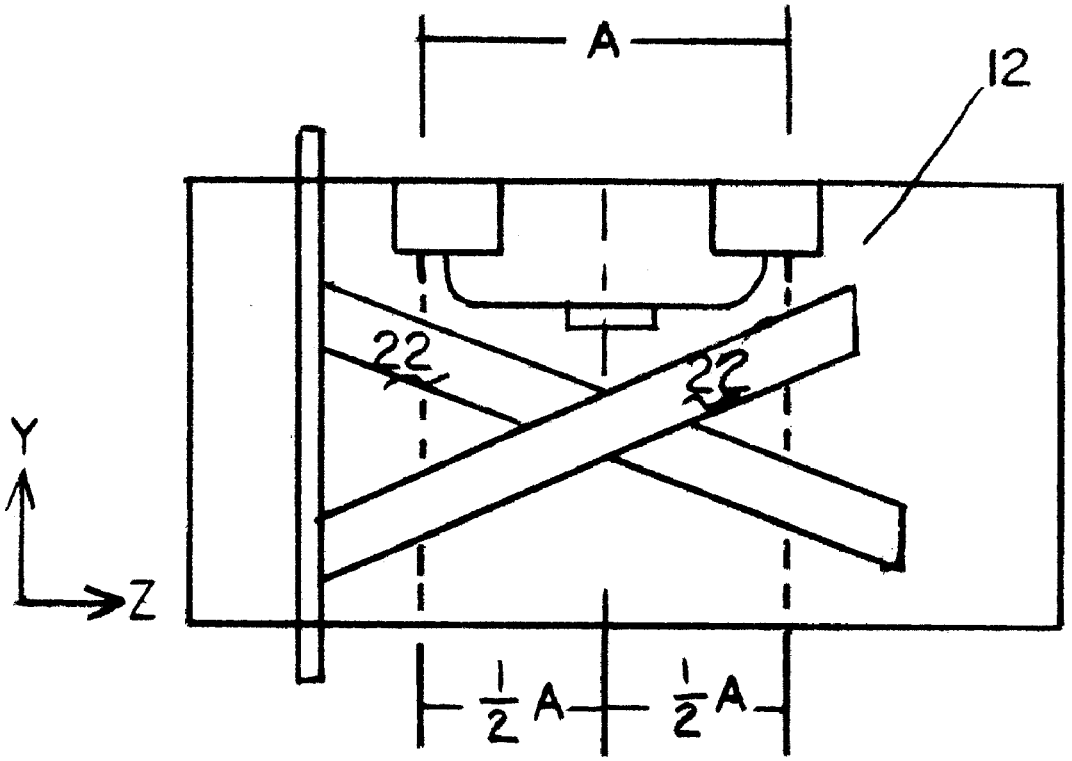
FIG. 7 is a top schematic view of a different method of trimming the X member according to the present invention.

An alternative to trimming the X member 12 with a table saw and two fences of FIGS. 5–6 is to use a double head radial arm saw having two saw heads. The double head radial arm saw is shown from a top view in FIG. 7. The double head radial arm saw includes a table, fence, a fix head and a movable head. The fixed head and the movable head each include a saw blade to cut the legs 22 of the X member 12 to size. The fence is secured on the table and positioned outside of the fixed head. The fixed head moves in the Y direction, but is fixed in the Z direction. The movable head moves in the Y direction and is adjustable in the Z direction. The fixed head and movable head move in the Y direction together in unison during the cutting process, whereby the saw blades of the heads cut in the Y direction. The heads can be moved using either a manual or automated system. The object is to assemble the legs 22 to form the X member 12, whereby a desired distance A from tip to tip, shown in FIG. 2, is maintained so that the floor-bridging unit 10 is a desired size when completed. The desired size depends on the spacing of the floor joists 18 that the floor-bridging unit 10 will be between. As shown in FIG. 3, a distance B from the tip of the index end to the dado slot 24 of each leg 22 is know, which is usually longer then needed. The known distance B allows for setting up and consistently trimming the legs 22 on the double head radial arm saw The fence is secured to the table at a distance outside the fixed head, whereby when the indexed ends of the X member 12 are placed against the fence, the distance from the center of the X member 12 to the saw blade of the fixed head is one half of the desired distance A. The movable head is then positioned in the Z direction, such that the distance of the center of the X member 12 to the saw blade of the movable head is one half of the desired distance A. Once the fence and heads are positioned and the X member 12 is placed on the table, the heads are moved in the Y direction to cut off the ends of the X member 12.

Figure 8:
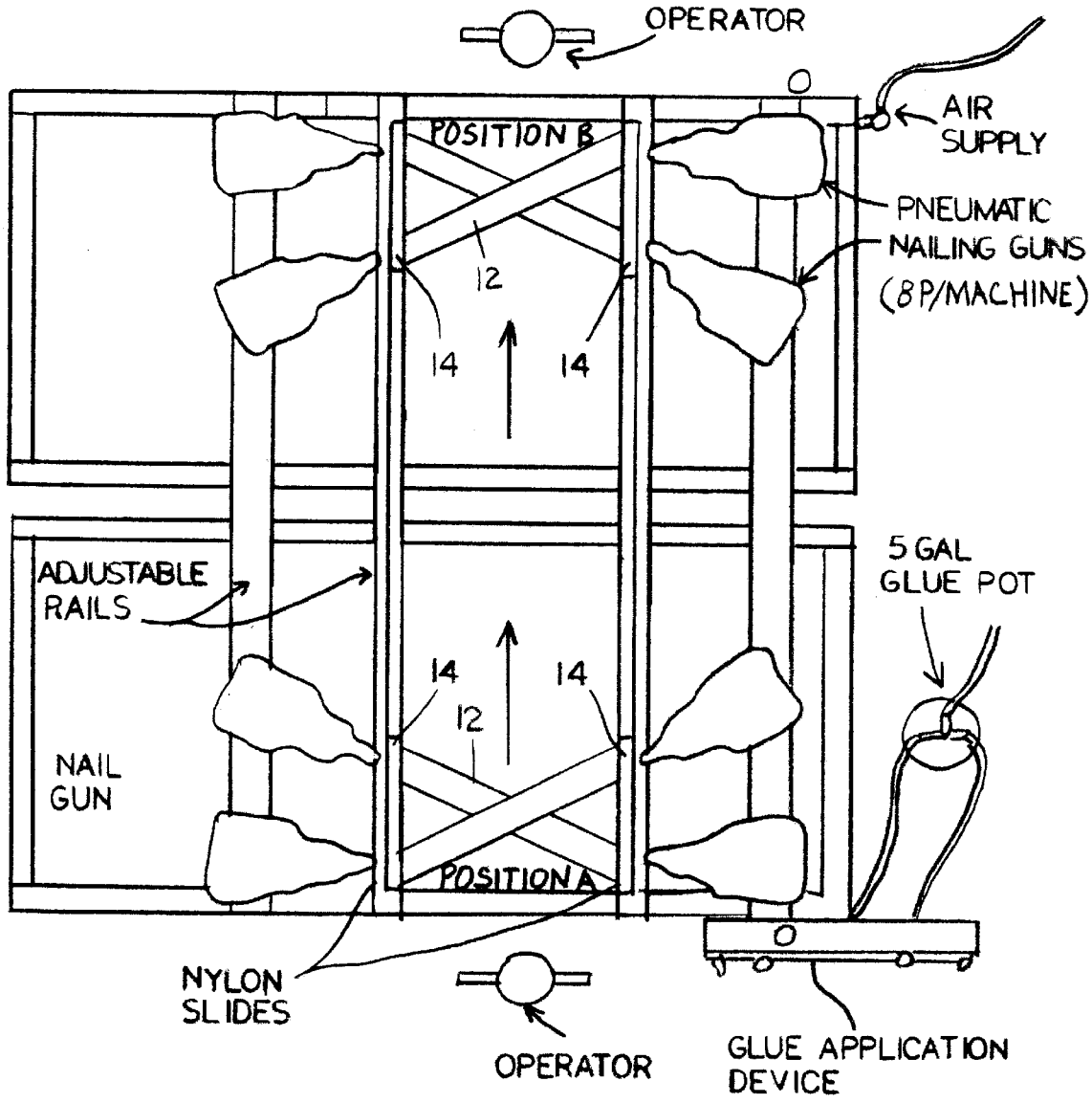
FIG. 8 is a top schematic view of the X member on a nailing jig according to the present invention.

Meanwhile, 4 foot×8 foot sheets of plywood are stacked four high and ripped lengthwise into 3 7/16 inch wide strips in a programmable panel saw. The 3 7/16 inch wide strips four high are cut to length in the same machine to form the flanges 14. The finished flanges 14 are then moved on a conveyer to the nailing jig. Flanges 14 and the X members 12 are joined using the following procedure, as shown in FIG. 8. At the nailing station, two flanges 14 are placed in the nailing jig in position A, as shown in FIG. 8. Glue is applied onto the ends of the X member 12 either manually or using a glue application device. The X member 12 is placed in the nailing jig between the flanges 14. There are two sets of four automated nail guns to join the flanges 14 and the X members 12, where one set is at position A and the other set is at position B. At position A, the forward nail guns are at an angle to the flanges 14 and the rearward nail guns are straight on at the flanges 14. When fired, the forward nail guns shoot the nails into the flanges 14 and legs 22 on an angle and the rearward nail guns shoot the nails straight into the flanges 14 and legs 22. After nailing at position A, the semi-assembled floor-bridging unit 10 is slid to position B. At position B, the rearward nail guns are at an angle to the flanges 14 and the forward nail guns are straight on at the flanges 14. When fired, the rearward nail guns shoot the nails into the flanges 14 and legs 22 on an angle and the forward nail guns shoot the nails straight into the flanges 14 and legs 22. Finished floor-bridging units 10 are stacked and sent to final packaging. At final packaging, the floor-bridging units 10 are nested, an installation guide is added, and the bundle is banded together. Bundles are stacked on a pallet and stretched-wrapped when full.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention which is to be given the full breadth of any and all equivalents thereof.

We claim:

1. A method of producing a floor-bridging unit, the floor-bridging unit including a X member of two legs, two flanges attached to sides of the X member and where a distance A between the flanges is a desired distance which sets the size of the floor-bridging unit, the method comprising:

cutting legs to a desired length, the desired length of each leg being long enough to produce the X member having the distance A between the flanges;

indexing one end of each leg, such that the same end of each leg is indexed in relation to the cutting of the legs for assembly of the floor-bridging unit;

cutting a dado slot near the middle of each leg to remove material in each leg, the dado slot being a set distance from the indexed end of each leg;

assembling the X member by assembling two legs together at the dado slot of each leg to form the X member, such that the indexed end of each leg is on the same side of the X member;

trimming the sides of the assembled X member which receive the flanges, such that the distance between the sides are the distance A;

applying glue to the sides of the assembled X member which receive the flanges;

placing the X member in a nailing station of a plurality of nail guns;

positioning the flanges against the sides of the X member; and nailing the flanges to the sides of the X member.

2. The method of claim 1, wherein indexing of the legs is done by marking the end of the legs.

3. The method of claim 1, wherein trimming of the X member is accomplished by using a table saw; wherein the table saw includes a left fence and a right fence; wherein the X member is place on the table of the table saw such that the index ends are placed against the left fence; wherein the right side of the X member is trimmed by running the index ends along the left fence and the right side through a saw blade of the table saw; wherein the distance between the center of the X member and the trimmed right side is one half of the distance A; wherein the X member is then moved such that the newly trimmed right side is positioned against the right fence, so that the indexed ends can be trimmed; and wherein the indexed ends of the X member is trimmed by running the ends of the trimed right side along the right fence and the indexed ends through a saw blade of the table saw, such that the distance between the center of the X member and the trimmed indexed ends is one half of the distance A.

4. The method of claim 1, wherein trimming of the X member is accomplished by using a double head radial arm saw having two saw heads; wherein the double head radial arm saw includes a table, fence, a fix head and a movable head; wherein the table has a length and a width; wherein the fixed head and the movable head each include a saw blade to cut the legs of the X to size; wherein the fence is secured on the table along the width and positioned outside of the fixed head; wherein the fixed head moves in the width direction, but is fixed in the length direction; wherein the movable head moves in the width direction and is adjustable in the length direction; wherein the fixed head and movable head move in the width direction together in unison during the cutting process; wherein the saw blades of the heads cut in the width direction; wherein the fence is secured to the table at a distance outside the fixed head, whereby when the indexed ends of the X are placed against the fence, the distance from the center of the X to the saw blade of the fixed head is one half of the desired distance A; wherein the movable head is then adjusted and fixed in the length direction, such that the distance of the center of the X to the saw blade of the movable head is one half of the desired distance A; wherein the X member is placed on the table, such that the indexed ends are against the fence; and wherein the heads are moved in the width direction to cut off the ends of the X.

5. The method of claim 1, wherein there are two sets of four automated nail guns to join the flanges and the X member; wherein one set is at a position A on the nailing station having two nails guns positioned forward and two nails guns positioned rearward; wherein the second set is at a position B on the nailing station having two nails guns positioned forward and two nails guns positioned rearward and wherein nails are fired into the flanges at position A and the X member and the flanges are moved to position B where nails are fired into the flanges to assemble the floor-bridging unit.

6. The method of claim 1, wherein there are two sets of four automated nail guns to join the flanges and the X member; wherein one set is at a position A on the nailing station having two nails guns positioned forward and two nails guns positioned rearward; wherein the second set is at a position B on the nailing station having two nails guns positioned forward and two nails guns positioned rearward; wherein at position A the forward nail guns are at an angle to the flanges and the rearward nail guns are straight on at the flanges, such that when the guns at position A are fired, the forward nail guns shoot the nails into the flanges and legs on an angle and the rearward nail guns shoot the nails straight into the flanges and legs; wherein the nails are fired into the flanges at position A; wherein after nailing at position A, a semi-assembled floor-bridging unit is slid to position B; wherein at position B, the rearward nail guns are at an angle to the flanges and the forward nail guns are straight on at the flanges, such that when fired, the rearward nail guns shoot the nails into the flanges and legs on an angle and the forward nail guns shoot the nails straight into the flanges and legs; and wherein the nails are fired into the flanges at position B.

7. The method of claim 1, wherein trimming of the X member is accomplished by using a table saw; wherein the table saw includes a left fence and a right fence; wherein the X member is place on the table of the table saw such that the index ends are placed against the left fence; wherein the right side of the X member is trimmed by running the index ends along the left fence and the right side through a saw blade of the table saw; wherein the distance between the center of the X member and the trimmed right side is one half of the distance A; wherein the X member is then moved such that the newly trimmed right side is positioned against the right fence, so that the indexed ends can be trimmed; and wherein the indexed ends of the X member is trimmed by running the ends of the trimed right side along the right fence and the indexed ends through a saw blade of the table saw, such that the distance between the center of the X member and the trimmed indexed ends is one half of the distance A; and wherein there are two sets of four automated nail guns to join the flanges and the X member; wherein one set is at a position A on the nailing station having two nails guns positioned forward and two nails guns positioned rearward; wherein the second set is at a position B on the nailing station having two nails guns positioned forward and two nails guns positioned rearward; wherein at position A the forward nail guns are at an angle to the flanges and the rearward nail guns are straight on at the flanges, such that when the guns at position A are fired, the forward nail guns shoot the nails into the flanges and legs on an angle and the rearward nail guns shoot the nails straight into the flanges and legs; wherein the nails are fired into the flanges at position A; wherein after nailing at position A, a semi-assembled floor-bridging unit is slid to position B; wherein at position B, the rearward nail guns are at an angle to the flanges and the forward nail guns are straight on at the flanges, such that when fired, the rearward nail guns shoot the nails into the flanges and legs on an angle and the forward nail guns shoot the nails straight into the flanges and legs; and wherein the nails are fired into the flanges at position B.

8. The method of claim 1, wherein trimming of the X member is accomplished by using a double head radial arm saw having two saw heads; wherein the double head radial arm saw includes a table, fence, a fix head and a movable head; wherein the table has a length and a width; wherein the fixed head and the movable head each include a saw blade to cut the legs of the X to size; wherein the fence is secured on the table along the width and positioned outside of the fixed head; wherein the fixed head moves in the width direction, but is fixed in the length direction; wherein the movable head moves in the width direction and is adjustable in the length direction;

wherein the fixed head and movable head move in the width direction together in unison during the cutting process; wherein the saw blades of the heads cut in the width direction; wherein the fence is secured to the table at a distance outside the fixed head, whereby when the indexed ends of the X are placed against the fence, the distance from the center of the X to the saw blade of the fixed head is one half of the desired distance A; wherein the movable head is then adjusted and fixed in the length direction, such that the distance of the center of the X to the saw blade of the movable head is one half of the desired distance A; wherein the X member is placed on the table, such that the indexed ends are against the fence; and wherein the heads are moved in the width direction to cut off the ends of the X; and wherein there are two sets of four automated nail guns to join the flanges and the X member; wherein one set is at a position A on the nailing station having two nails guns positioned forward and two nails guns positioned rearward; wherein the second set is at a position B on the nailing station having two nails guns positioned forward and two nails guns positioned rearward; wherein at position A the forward nail guns are at an angle to the flanges and the rearward nail guns are straight on at the flanges, such that when the guns at position A are fired, the forward nail guns shoot the nails into the flanges and legs on an angle and the rearward nail guns shoot the nails straight into the flanges and legs; wherein the nails are fired into the flanges at position A; wherein after nailing at position A, a semi-assembled floor-bridging unit is slid to position B; wherein at position B, the rearward nail guns are at an angle to the flanges and the forward nail guns are straight on at the flanges, such that when fired, the rearward nail guns shoot the nails into the flanges and legs on an angle and the forward nail guns shoot the nails straight into the flanges and legs; and wherein the nails are fired into the flanges at position B.

9. A method of producing a floor-bridging unit, the floor-bridging unit including a X member of two legs, two flanges attached to sides of the X member and where a distance A between the flanges is a desired distance which sets the size of the floor-bridging unit, the method comprising:

cutting legs to a desired length, the desired length of each leg being long enough to produce the X member having the distance A between the flanges;

indexing one end of each leg, such that the same end of each leg is indexed in relation to the cutting of the legs for assembly of the floor-bridging unit;

cutting a dado slot near the middle of each leg to remove material in each leg, the dado slot being a set distance from the indexed end of each leg;

assembling the X member by assembling two legs together at the dado slot of each leg to form the X member, such that the indexed end of each leg is on the same side of the X member;

trimming the sides of the assembled X member which receive the flanges, such that the distance between the sides are the distance A;

placing the X member in a nailing station of a plurality of nail guns;

positioning the flanges against the sides of the X member; and nailing the flanges to the sides of the X member.

10. The method of claim 9, wherein indexing of the legs is done by marking the end of the legs.

11. The method of claim 9, wherein trimming of the X member is accomplished by using a table saw; wherein the table saw includes a left fence and a right fence; wherein the X member is place on the table of the table saw such that the index ends are placed against the left fence; wherein the right side of the X member is trimmed by running the index ends along the left fence and the right side through a saw blade of the table saw; wherein the distance between the center of the X member and the trimmed right side is one half of the distance A; wherein the X member is then moved such that the newly trimmed right side is positioned against the right fence, so that the indexed ends can be trimmed; and wherein the indexed ends of the X member is trimmed by running the ends of the trimed right side along the right fence and the indexed ends through a saw blade of the table saw, such that the distance between the center of the X member and the trimmed indexed ends is one half of the distance A.

12. The method of claim 9, wherein trimming of the X member is accomplished by using a double head radial arm saw having two saw heads; wherein the double head radial arm saw includes a table, fence, a fix head and a movable head; wherein the table has a length and a width; wherein the fixed head and the movable head each include a saw blade to cut the legs of the X to size; wherein the fence is secured on the table along the width and positioned outside of the fixed head; wherein the fixed head moves in the width direction, but is fixed in the length direction; wherein the movable head moves in the width direction and is adjustable in the length direction; wherein the fixed head and movable head move in the width direction together in unison during the cutting process; wherein the saw blades of the heads cut in the width direction; wherein the fence is secured to the table at a distance outside the fixed head, whereby when the indexed ends of the X are placed against the fence, the distance from the center of the X to the saw blade of the fixed head is one half of the desired distance A; wherein the movable head is then adjusted and fixed in the length direction, such that the distance of the center of the X to the saw blade of the movable head is one half of the desired distance A; wherein the X member is placed on the table, such that the indexed ends are against the fence; and wherein the heads are moved in the width direction to cut off the ends of the X.

13. The method of claim 9, wherein there are two sets of four automated nail guns to join the flanges and the X member; wherein one set is at a position A on the nailing station having two nails guns positioned forward and two nails guns positioned rearward; wherein the second set is at a position B on the nailing station having two nails guns positioned forward and two nails guns positioned rearward and wherein nails are fired into the flanges at position A and the X member and the flanges are moved to position B where nails are fired into the flanges to assemble the floor-bridging unit.

14. The method of claim 9, wherein there are two sets of four automated nail guns to join the flanges and the X member; wherein one set is at a position A on the nailing station having two nails guns positioned forward and two nails guns positioned rearward; wherein the second set is at a position B on the nailing station having two nails guns positioned forward and two nails guns positioned rearward; wherein at position A the forward nail guns are at an angle to the flanges and the rearward nail guns are straight on at the flanges, such that when the guns at position A are fired, the forward nail guns shoot the nails into the flanges and legs on an angle and the rearward nail guns shoot the nails straight into the flanges and legs; wherein the nails are fired into the flanges at position A; wherein after nailing at position A, a semi-assembled floor-bridging unit is slid to position B; wherein at position B, the rearward nail guns are at an angle to the flanges and the forward nail guns are straight on at the flanges, such that when fired, the rearward nail guns shoot the nails into the flanges and legs on an angle and the forward nail guns shoot the nails straight into the flanges and legs; and wherein the nails are fired into the flanges at position B.

15. The method of claim 9, wherein trimming of the X member is accomplished by using a table saw; wherein the table saw includes a left fence and a right fence; wherein the X member is place on the table of the table saw such that the index ends are placed against the left fence; wherein the right side of the X member is trimmed by running the index ends along the left fence and the right side through a saw blade of the table saw; wherein the distance between the center of the X member and the trimmed right side is one half of the distance A; wherein the X member is then moved such that the newly trimmed right side is positioned against the right fence, so that the indexed ends can be trimmed; and wherein the indexed ends of the X member is trimmed by running the ends of the trimed right side along the right fence and the indexed ends through a saw blade of the table saw, such that the distance between the center of the X member and the trimmed indexed ends is one half of the distance A; and wherein there are two sets of four automated nail guns to join the flanges and the X member; wherein one set is at a position A on the nailing station having two nails guns positioned forward and two nails guns positioned rearward; wherein the second set is at a position B on the nailing station having two nails guns positioned forward and two nails guns positioned rearward; wherein at position A the forward nail guns are at an angle to the flanges and the rearward nail guns are straight on at the flanges, such that when the guns at position A are fired, the forward nail guns shoot the nails into the flanges and legs on an angle and the rearward nail guns shoot the nails straight into the flanges and legs; wherein the nails are fired into the flanges at position A; wherein after nailing at position A, a semi-assembled floor-bridging unit is slid to position B; wherein at position B, the rearward nail guns are at an angle to the flanges and the forward nail guns are straight on at the flanges, such that when fired, the rearward nail guns shoot the nails into the flanges and legs on an angle and the forward nail guns shoot the nails straight into the flanges and legs; and wherein the nails are fired into the flanges at position B.

16. The method of claim 9, wherein trimming of the X member is accomplished by using a double head radial arm saw having two saw heads; wherein the double head radial arm saw includes a table, fence, a fix head and a movable head; wherein the table has a length and a width; wherein the fixed head and the movable head each include a saw blade to cut the legs of the X to size; wherein the fence is secured on the table along the width and positioned outside of the fixed head; wherein the fixed head moves in the width direction, but is fixed in the length direction; wherein the movable head moves in the width direction and is adjustable in the length direction; wherein the fixed head and movable head move in the width direction together in unison during the cutting process; wherein the saw blades of the heads cut in the width direction; wherein the fence is secured to the table at a distance outside the fixed head, whereby when the indexed ends of the X are placed against the fence, the distance from the center of the X to the saw blade of the fixed head is one half of the desired distance A; wherein the movable head is then adjusted and fixed in the length direction, such that the distance of the center of the X to the saw blade of the movable head is one half of the desired distance A; wherein the X member is placed on the table, such that the indexed ends are against the fence; and wherein the heads are moved in the width direction to cut off the ends of the X; and wherein there are two sets of four automated nail guns to join the flanges and the X member; wherein one set is at a position A on the nailing station having two nails guns positioned forward and two nails guns positioned rearward; wherein the second set is at a position B on the nailing station having two nails guns positioned forward and two nails guns positioned rearward; wherein at position A the forward nail guns are at an angle to the flanges and the rearward nail guns are straight on at the flanges, such that when the guns at position A are fired, the forward nail guns shoot the nails into the flanges and legs on an angle and the rearward nail guns shoot the nails straight into the flanges and legs; wherein the nails are fired into the flanges at position A; wherein after nailing at position A, a semi-assembled floor-bridging unit is slid to position B; wherein at position B, the rearward nail guns are at an angle to the flanges and the forward nail guns are straight on at the flanges, such that when fired, the rearward nail guns shoot the nails into the flanges and legs on an angle and the forward nail guns shoot the nails straight into the flanges and legs; and wherein the nails are fired into the flanges at position B.

* * * * *